United States Patent [19]

Linn

[11] Patent Number: 5,032,092

[45] Date of Patent: Jul. 16, 1991

[54] POWER DISTRIBUTION BLOCK

[75] Inventor: Richard L. Linn, Lake Forest, Ill.

[73] Assignee: Connection Designs Corporation, Lake Forest, Ill.

[21] Appl. No.: 455,164

[22] Filed: Dec. 22, 1989

[51] Int. Cl.[5] ..... H01R 11/09

[52] U.S. Cl. ..... 439/723; 439/814; 439/907

[58] Field of Search ..... 439/709, 710, 711, 712, 439/713, 715, 720, 721, 722, 723, 724, 810, 814, 907

[56] References Cited

U.S. PATENT DOCUMENTS

| | | | |
|---|---|---|---|
| 2,748,365 | 5/1956 | Speck | 439/723 |
| 2,787,773 | 4/1957 | Potter | 439/715 |
| 2,909,757 | 10/1959 | Speck | 439/723 |
| 3,072,879 | 1/1963 | Crowther | 439/709 |
| 3,124,409 | 3/1964 | Nisula . | |
| 3,171,708 | 3/1965 | Salomone | 439/724 |
| 3,605,067 | 9/1971 | Szabo et al. . | |
| 3,629,806 | 12/1971 | Wiechmann . | |
| 3,693,137 | 9/1972 | Brumfield | 439/814 |
| 3,725,851 | 4/1973 | Linn . | |
| 3,732,530 | 5/1973 | Linn et al. . | |
| 3,915,545 | 10/1975 | Saito | 439/724 |
| 4,050,770 | 9/1977 | Rigo | 439/724 X |

*Primary Examiner*—Neil Abrams
*Assistant Examiner*—Khiem Nguyen
*Attorney, Agent, or Firm*—Lockwood, Alex, Fitzgibbon & Cummings

[57] ABSTRACT

A unitary power distribution block particularly suitable for high amperage application is disclosed. This new power distribution block features an electrical contact member in the form of a copper bus bar having distinct conductor engagement surfaces disposed in different horizontal planes. The bus bar is held within a steel skeleton to form an internal assembly and a shell of nonconductive material is molded around the internal assembly. The shell has a number of distinct conductor receiving cavities disposed on different horizontal planes of the distribution block.

22 Claims, 2 Drawing Sheets

POWER DISTRIBUTION BLOCK

BACKGROUND AND SUMMARY OF THE INVENTION

The present invention relates generally to the distribution of electrical power from one or more electrical feed cables to a plurality of electrical branch cables and more particularly, to an improved electrical power distribution block suitable for high-amperage industrial applications.

Terminal assemblies and power distribution blocks have been widely utilized in the past for connecting high amperage electrical service cables to a number of smaller amperage electrical service cables for the purpose of distributing incoming electrical power to a number of distinct circuits. In some instances, such terminal assemblies and power distribution blocks contain a number of small components such as electrical contact members and frame members therefor which must be firmly in place on the terminal assembly prior to connecting any electrical service cables.

Other distribution blocks utilize the same material of construction for both the electrical contact member, the frame and any insulated mounting bar. In such circumstances, a rise in temperature which occurs during operation may spread throughout the block and result in uncontrolled thermal expansion of the same which can result in binding of the screws which hold the cables in place in the block.

The present invention is directed to an improved power distribution block construction which avoids the above-mentioned shortcomings.

In a power distribution block incorporating the principles of the present invention, the distribution of power from one or more high amperage primary conductors to a plurality of low amperage secondary conductors may be accomplished by way of a multi-planar copper electrical contact member held within a steel carrier and further held within a nonconductive housing wherein access to the electrical contact member is provided by a series of first and second recesses extending into the block.

In one principal aspect of the present invention, a power distribution block assembly includes a copper bus bar having a plurality of parallel electrical contact surfaces disposed in distinct horizontal planes. The bus bar is held in place within an insulative housing molded from a non-conducting material by a steel skeleton having a plurality of openings which engage the wire engagement surfaces of the bus bar.

In another aspect of the present invention, a nonconductive housing surrounds both the steel skeleton and bus bar and is further provided with a series of first and second conductor recesses each having distinct recess surfaces formed by portions of the bus bar, the steel skeleton and the housing.

Accordingly, it is an object of the present invention to provide a power distribution block for relatively high amperage applications having an electrical contact member with a plurality of conductor engaging surfaces contained within an insulative housing molded from a non-conducting material.

It is another object of the present invention to provide an integral terminal assembly block suitable for high amperage applications having an internal assembly which includes a copper electrical contact member supported by a steel carrier frame, the internal assembly being housed in a nonconductive housing, the housing having a series of first and second recesses adapted to engage primary and secondary electrical conductors therein.

It is a further object of the present invention to provide a molded unitary connector which greatly facilitates visual inspections of the connector after all connections are made.

It is yet a further object of the present invention to provide a molded unitary connector particularly suitable for high amperage connections which requires no assembly and which has a plurality of first and second recesses, each of the first and second recesses providing an electrical transfer surface beneath each conductor held within the first or second recesses, substantially all of the electrical transfer surface and the carrier frame being contained within the molded exterior.

These and other objects and advantages of the present invention will be clearly understood through a consideration of the following detailed description.

BRIEF DESCRIPTION OF THE DRAWINGS

In the course of this detailed description, reference will be frequently made to the attached drawings in which.

DETAILED DESCRIPTION OF THE DRAWINGS

Figure 1:
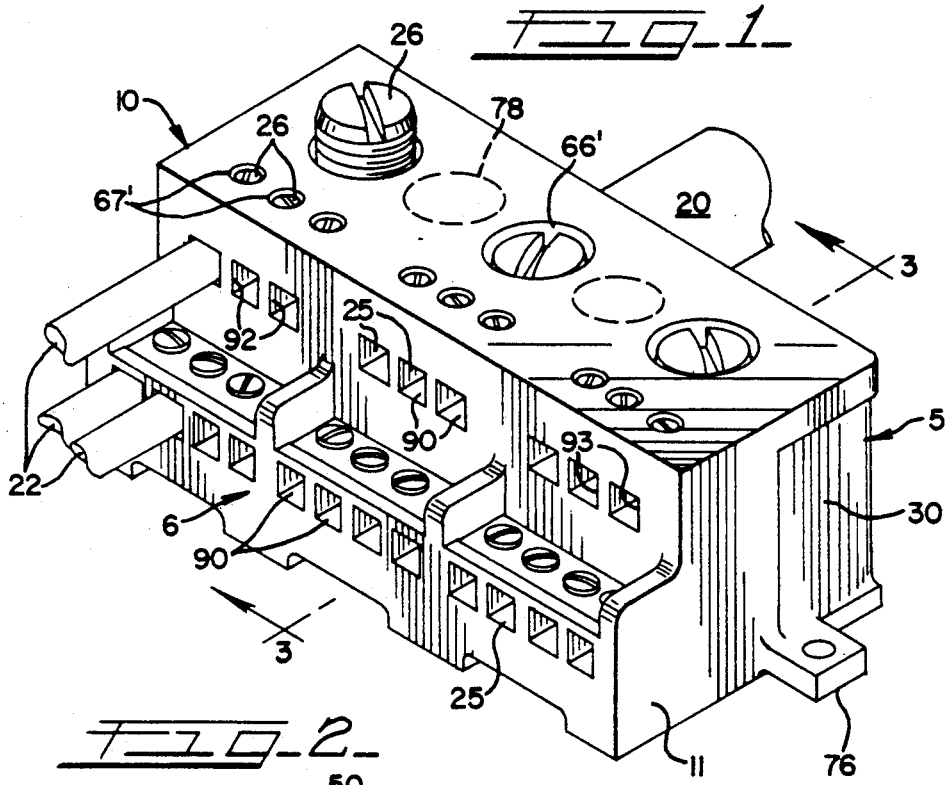
FIG. 1 is a perspective view of one embodiment of a power distribution block incorporating the principles of the present invention.

FIG. 1 illustrates first embodiment of a power distribution block 10 constructed in accordance with the principles of the present invention. The power distribution block 10 comprises an outer shell or housing 11, an electrical contact member 12 positioned within the housing 11, carrier means 14 for retaining the electrical contact member 12 in a predetermined position within the housing in and securing means 16 for electrically connecting a series of primary and secondary electrical wires on conductors 20, 22 to the electrical contact member 12.

The power distribution block 10 is used to distribute electrical power from one or more relatively large, high-amperage primary conductors 20 which are received in the housing by way of first cavities or recesses 24 on the incoming side 5 of the block so as to provide incoming power to the block 10 to a series of relatively smaller low-amperage secondary conductors 22 which are received in the housing by way of similar second cavities or recesses 25 located on the opposite or outgoing side 6 of the block. The electrical contact member 12 positioned within the block 10 provides a path for the distribution of incoming electrical power to multiple, distinct outgoing electrical circuits. The incoming primary conductors 20 are secured within their corresponding primary cavities 24 by means of compression screws 26 which are seated in housing bores 66' and 67' extending through the housing 11 and which threadedly engage the internal metal carrier frame 15. The secondary outgoing conductors 22 are similarly secured within their corresponding secondary cavities 25 located on the outgoing side 6 of the block.

Figure 2:
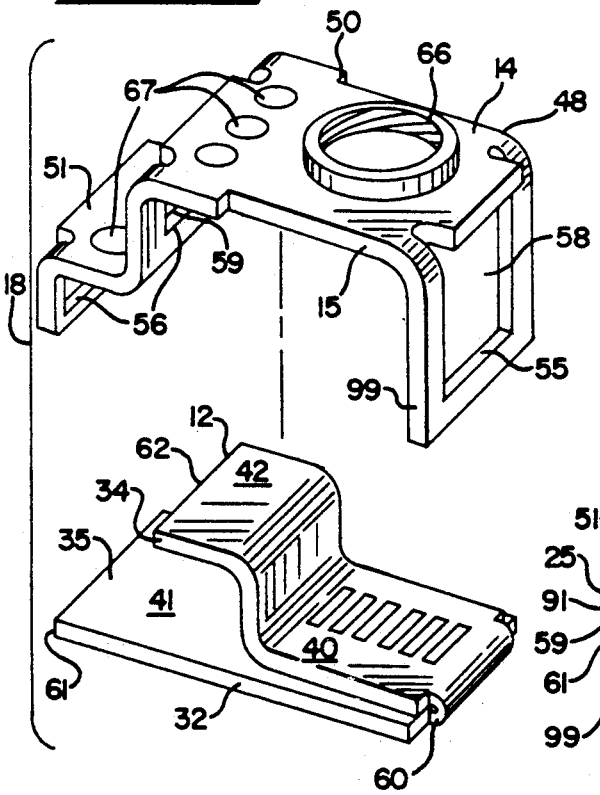
FIG. 2 is an exploded view of the internal transfer member and carrier frame contained within the power distribution block of FIG. 2.
Figure 3:
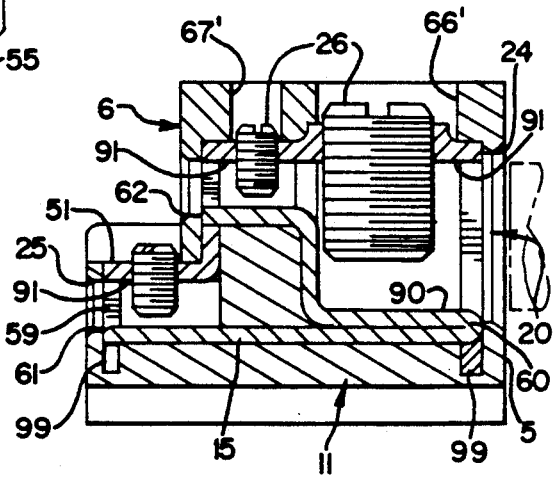
FIG. 3 is a sectional view taken along lines 3—3 of FIG. 2.

Although the power distribution block 10 shown in FIGS. 1–3 is a "multiple" block, that is, a distribution block which accommodates more than one primary incoming conductor 20 and having more than one internal bus bar assembly 18 operatively associated therewith, the description herein which follows will be generally phrased in terms of a "single" block, that is, a distribution block which accommodates only one incoming primary conductor 20 and one internal bus bar assembly 18 operatively associated therewith. It will be understood, however, that this description equally applies to "multiple" blocks and is not to be limited to a "single" block because the internal bus bar assemblies 18 used in a "multiple" block are identical.

As best seen in FIG. 2, the electrical contact member 12 is formed from an electrically conductive metal strip 32 of a preselected length. The metal strip 32 is folded upon itself to form a multi-planar electrical bus bar 33 having a stepped configuration to define a top contact portion 34 and a bottom contact portion 35. The top contact portion 34 illustrated has two "steps" which contain a primary conductor engagement surface 40 and a secondary conductor engagement surface 42 thereon. Another secondary conductor engagement surface 41 lies generally behind the primary conductor engagement surface 40. The multi-planar bus bar 33 thereby defines three distinct conductor engagement surfaces 40, 41 and 42 which are substantially parallel to each other and which lie in generally distinct horizontal planes.

These three conductor engagement surfaces are separated into a primary conductor engagement surface 40 which engages the incoming primary wire 20 and two secondary conductor engagement surfaces 41 and 42, which engage the outgoing, secondary wires 22. As will be explained in greater detail below, these three bus bar engagement surfaces 40, 41 and 42 form at least one surface of each of the primary and secondary conductor receiving cavities 24 and 25.

The multi-planar bus bar 33 is held in place within the molded housing 11 by a metal skeleton or carrier frame 15. The carrier frame 15 is preferably formed from a conductive metal strip 48, such as steel, to add support and rigidity to the internal bus bar assembly 18. Because the steel carrier frame 15 has a lower electrical conductivity from the copper bus bar 33, substantially all of the electricity conveyed by the incoming primary wires 20 is transmitted through the bus bar 33 to the secondary engagement surfaces 41, 42 and further to the outgoing secondary wires 22. Therefore, the copper bus bar 33 will bear most of the heat associated with the transmission of electrical power rather than the steel carrier frame 15. The carrier frame 15 also has a stepped configuration similar to that of the bus bar 33 which defines two steps or surfaces 50 and 51. These surfaces 50 and 51 are disposed generally parallel to each other in different horizontal planes.

The carrier frame 15 is provided with a series of generally rectangular openings 58, 59 located on opposite sides of the carrier frame 15. The openings 58, 59 are located on opposite sides o the carrier frame 15. Each such opening 58, 59 has a ledge 55, 56 associated therewith which defines the bottom of the openings 58, 59. The multi-planar bus bar 33 is preferably dimensioned so that the respective ends 60, 61 and 62 of its conductor engagement surfaces 40, 41 & 42 fit into the carrier openings 58, 59 and engage the carrier opening ledges 55, 56. The major conductor engagement surface end 60 may be indented at its corners to engage the posts 64 of the primary carrier opening 59. A series of screw holes 66, 67 are provided in the parallel top surfaces 50, 51 of the carrier frame 15 which accommodate threaded compression screws 26 and 27.

The multi-planar bus bar 33 is inserted into the carrier frame 15 to form an internal bus bar assembly 18 wherein each of the three bus bar conductor engagement surfaces 40, 41 and 42 are disposed beneath the screw holes 66, 67 and are disposed generally parallel to the carrier frame surfaces 50, 51. An insulative shell or housing 11 is then molded from a non-conductive material substantially around the entire internal bus bar assembly 18. Lower extensions 99 of the carrier frame 15 are preferably provided to further anchor the internal bus bar assembly 18 in place within the molded housing 11. Where a "single" block is desired, only one internal assembly 18 is inserted into a mold and where a "multiple" block is desired, multiple internal assemblies 18 are inserted into a mold and the shell 30 is molded around them. Thus it will be appreciated that the present invention affords particular manufacturing advantages by virtue of its modular characteristics.

The molded housing 11 has a series of housing bores 66', 67' formed therein which overlie the carrier frame set screw openings 66 and 67 and provide access to the threaded portions of the carrier frame 15. The molded housing extends around the internal bus bar assembly 18, substantially covering the same such that substantially all of the conductor engagement surfaces 40–42 of the bus bar 13 are contained within the block housing 11. As such, the bus bar 33 is afforded desirable protection against corrosion when used in extreme environments. The conductor-receiving first and second cavities or recesses, 24 and 25, are respectively molded in the housing so that they abut and generally correspond to the dimensions of the carrier frame openings 58, 59.

The first cavity or recess 24 for each internal bus bar assembly 18 is disposed on the incoming side 5 of the housing 11 and receives the primary conductor 20, while the remaining second cavities 25 are disposed on the opposite, outgoing side 6 of the housing 11 and receive the secondary conductors 22. Seven of such second cavities 25 are illustrated in FIG. 1 as being associated with each internal bus bar assembly 18. The second cavities 25 are located on two distinct horizontal planes of the outgoing side 6 so that the integrity of the connections of wires to the same can be easily and readily verified.

Each first and second conductor receiving cavity, 24 and 25, is defined by a plurality of internal surfaces 90–95. As best seen in FIG. 3, distinct portions of each of the bus bar conductor engagement surfaces 40, 41, 42 serve as a first (bottom) surface 90 for each primary and secondary cavities 24, 25, while distinct portions of the carrier frame 15 serve as a second (top) surface 91 of each such cavity. The sides of the primary and secondary cavities are further defined by distinct portions of the molded housing 11 which serve as third and fourth (side) surfaces of 92, 93 of each cavity. The remaining surface 95, which defines the rear of each of the cavities can be selectively formed from portions of the housing, the bus bar or the carrier frame.

The housing 11 may be molded with integral, outwardly extending mounting feet 76 for mounting the distribution block 10. However, it will be appreciated that in multiple block applications, mounting holes 78 (shown in phantom) may be drilled into and through the housing 11 between the separate internal assemblies 18 to counteract any torque applied by the conductor connections. Alternatively, the distribution block can include clips 140 which are integrally molded into the block and depend down from the block (as shown in FIGS. 4–6) so that the block 10 can be mounted onto a mounting bar.

Figure 4:
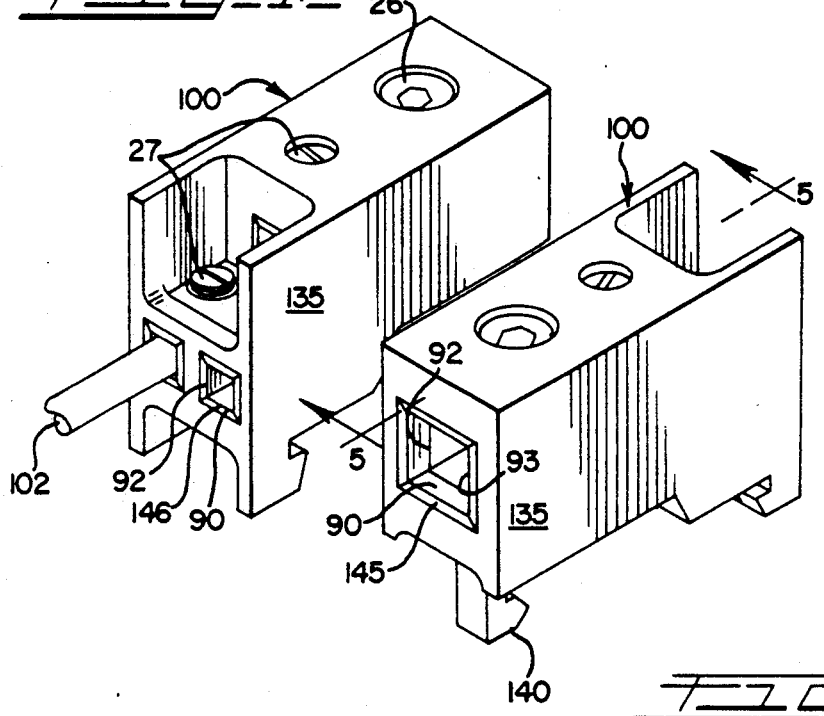
FIG. 4 is a perspective view of a second embodiment of a power distribution block incorporating the principles of the present invention.
Figure 5:
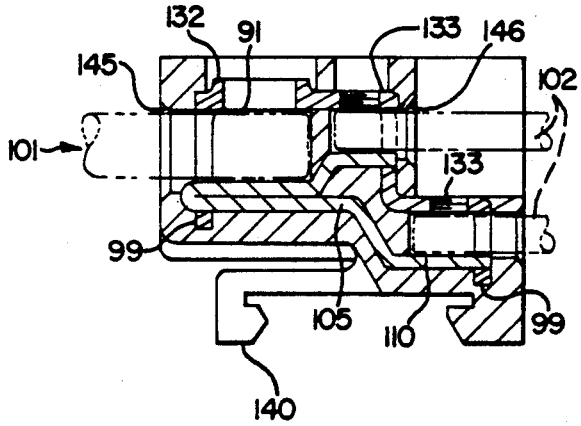
FIG. 5 is a sectional view taken along line 5—5 of FIG. 4.
Figure 6:
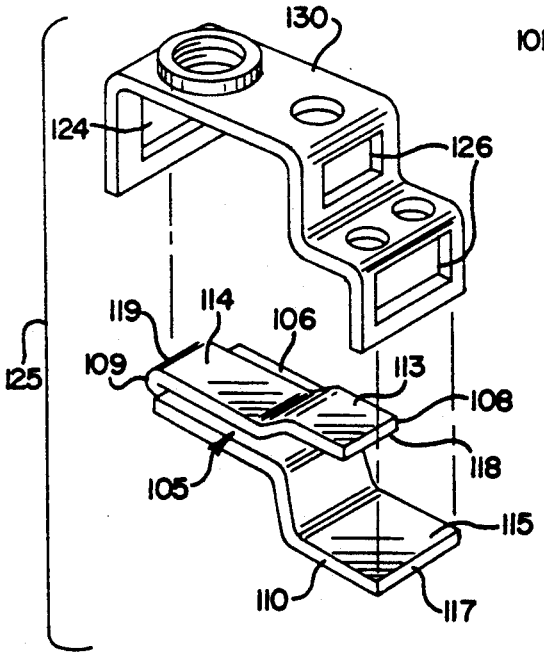
FIG. 6 is an exploded view of the internal transfer member and accompanying carrier frame of the power distribution block of FIG. 4.

A second embodiment of a power distinction block constructed in accordance with the principles of the present invention is show in FIGS. 4–6, which illustrate a "single" distribution block 100 accommodating one incoming primary wire 101. The distribution block 100 distributes electrical current from the primary wire 101 to three relatively small diameter, secondary wires 102 by way of an electrical contact member 104 formed as a multi-planar copper bus bar 105. Similar to the first embodiment, the bus bar 105 is formed from a conductive metal strip 106, preferably copper, and is folded over to form its multi-planar configuration having an upper portion 108, a middle portion 109 and a lower portion 110. The upper and lower portions 108 and 110 extend away from the middle portion 109 to define three distinct wire engagement surface 113, 114 and 115 which are generally parallel to each other and which are disposed in three distinct horizontal planes.

The respective ends 117, 118 and 119 of the bus bar conductor engagement surfaces 113, 114 and 115 are supported on the ledges 121, 122 of the carrier frame openings 124 and 126. The carrier frame 130 also has a multi-planar configuration so that its threaded compression screw holes 132 and 133 are located above the bus bar wire engagement surfaces 113, 114 and 115. The multi-planar bus bar 105 and the carrier frame 130 are assembled together to form an internal bus bar assembly 125 which then has an insulative shell or housing 135 molded around it from a nonconductive material. The housing 135 has a series of primary and secondary wire receiving cavities 145, 146 formed therein which mate with and correspond to the carrier openings 124, 126.

It will be appreciated that the present invention provides a modular internal bus bar assembly which can be used to efficiently mold variety of multiple or a single power distribution blocks and which will provide manufacturing advantages in terms of reduced costs, etc.

While two embodiments of the present invention have been shown and described, it will be obvious to those skilled in the art that changes and modifications may be made therein without departing from the true spirit of the scope of the invention.

What I claim is:

1. A power distribution block for distributing electricity from at least one incoming electrical service cable having a preselected diameter to at least one or more other outgoing electrical service cables having a preselected diameter, the power distribution block comprising:

means for providing an electrically conductive path between the incoming electrical service cable and the outgoing electrical service cables including a bus bar in the form of a multi-planar connector plate having a plurality of electrical contact surfaces thereon, each of the electrical contact surfaces being generally disposed parallel to each other, means for holding the multi-planar connector plate within a housing made of an insulative electrically nonconductive material, said holding means including a skeleton having a plurality of openings which engage portions of said multi-planar connector plate to form an internal connector assembly, the housing substantially surrounding the internal connector assembly and housing a plurality of cavities therein to accommodate said incoming and outgoing electrical service cables, and wherein portions of said bus bar, said frame and said housing cooperate to form the housing cavities, the skeleton enclosing said connector plate and further holding said connector plate in place within said housing in said housing-cavity forming relationship.

2. The power distribution block of claim 1, wherein said multi-planar connector plate is copper and said frame is steel and each of said cavities having an electrical contact surface closely associated therewith.

3. The power distribution block of claim 1, wherein said housing includes three primary cavities being adapted to receive three incoming electrical service cables, the primary cavities being disposed on one side of said housing, said housing further including twenty-one secondary cavities disposed on an opposite side of said housing, the twenty-one secondary cavities being adapted to receive twenty-one outgoing electrical service cables, the twenty-one secondary cavities being disposed in two different planes on the opposite side of said block and wherein each primary cavity has seven secondary cavities operatively associated therewith.

4. The power distribution block of claim 1, wherein said housing includes one primary cavity adapted to receive an incoming electrical service cable, the primary cavity being disposed on one side of said housing and wherein said housing has three secondary cavities adapted to receive three outgoing electrical service cables, the three secondary cavities being disposed on the opposite side of said housing said three secondary cavities being further disposed on at least two different planes of said housing opposite side, said three secondary cavities being operatively associated with said primary cavity.

5. The power distribution block of claim 1, wherein said frame includes means for anchoring said internal connector assembly within said housing and said power distribution block further includes means for retaining said incoming and outgoing electrical service cables within said power distribution block, said cable retention means including a plurality of compression screws threadedly disposed in said frame and disposed opposite the electrical contact surfaces, the compression screws being adapted to connect said electrical service cables to said electrical contact surfaces.

6. The power distribution block of claim 1, further including means for mounting said power distribution block on a surface, said mounting means including clip means formed as an integral extension of said housing.

7. An integral connector assembly particularly suitable for high amperage applications comprising:

carrier means in the form of a metal frame, the frame including means for holding an electrical transfer member therein within the boundaries of said frame;

electrical connection means in the form of a single metal electrical transfer member, the electrical transfer member having a plurality of conductor contact surfaces thereon;

said carrier means frame including a first means for securing at least one primary conductor in a first recess of a housing of said integral connector assembly and second means for securing a plurality of secondary conductors in second recesses of the housing;

said electrical transfer member conductor contact surfaces being held by said carrier means frame within said frame proximate to said first and second recesses.

8. The integral connector assembly of claim 7, further including first and second securing means respective operatively associated with said first and second recesses, the first and second securing means including a plurality of set screws, adapted to connect said primary and secondary conductors to said electrical transfer member when inserted into said first and second recesses, said set screws threadedly engaging said frame and angularly offset from said electrical transfer member.

9. The integral connector assembly of claim 7, wherein said housing first and second recesses are disposed parallel in said housing and said electrical transfer member is copper and said frame is steel.

10. The integral connector assembly of claim 7, wherein each of said first and second recesses have at least three distinct surfaces, portions of said frame forming one surface of each of said first and second recesses, portions of said electrical transfer member forming a second surface of each of said first and second recesses and portions of said housing forming a third surface of each of said first and second recesses.

11. The integral connector assembly of claim 7, wherein said housing first and second recesses are parallel and are disposed on different horizontal planes of said housing said second recesses further including at least two distinct second recesses disposed on two distinct planes of said housing.

12. The integral connector assembly of claim 7, wherein said electrical transfer member includes a multi-planar plate having three distinct conductor contact surfaces thereon, the bottom portion of the plate having a first conductor contact surface thereon and the top portion of the plate having two distinct conductor contact surfaces thereon, each of said conductor contact surfaces being disposed in a distinct horizontal plane.

13. The integral connector assembly of claim 7, further including means for attaching said integral connector assembly to a mounting surface in the form of clip means extending from said housing.

14. The integral connector assembly of claim 7, wherein said frame includes anchor means extending into portions of said housing.

15. The integral connector assembly of claim 7, wherein said casing is injection molded and substantially surrounds said frame.

16. A multiple wire connector comprising a multi-planar contact member having a plurality of electrical contact surfaces and a carrier frame holding said contact member in place within an insulative housing molded from a nonconductive material such that the electrical contact surfaces of said multi-planar contact member are disposed on different planes within the housing, said housing having a plurality of wire connector cavities, each of the cavities containing an electrical contact surface of said contact member, said carrier frame further holding said contact member in place within said carrier frame such that portions of said carrier frame and said contact member cooperate to form said wire connector cavities.

17. The multiple wire connector of claim 16, wherein said multi-planar contact member includes three electrical contact surfaces disposed generally parallel to each other within said housing, said housing further including means for retaining wire connectors within said wire connector cavities, the retaining means including a plurality of set screws threadedly engaging the carrier frame and penetrating through said housing into said wire connector cavities opposite said three electrical contact surfaces, said set screws being adapted to connect wires to said block inserted into said wire connector cavities.

18. The multiple wire connector of claim 16, wherein said multi-planar contact member includes a bus bar the electrical contact surfaces of said bus bar being disposed generally parallel to each other within said housing, each of said electrical contact surfaces forming portions of said wire connector cavities.

19. The multiple wire connector of claim 17, wherein each of said wire connector cavities includes at least three distinct surface, one of said cavity surfaces in each of said cavities being formed by said electrical contact surfaces, a second of said cavity surfaces in each of said cavities being formed by said carrier frame, and a third of said cavity surfaces in each of said cavities being formed by said housing.

20. The multiple wire connector of claim 16, wherein each of said electrical contact surfaces include a ledge which engages said carrier frame, and wherein said carrier frame includes means for retaining wires on said electrical contact surfaces within said wire connector cavities, said retaining means including screw means threadedly engaging said carrier frame opposite said electrical contact surfaces and penetrating through said housing said screw means being adapted to connect wires to said electrical contact surfaces of said multi-planar contact member when the wires are inserted into said wire connector cavities.

21. The multiple wire connector of claim 16, wherein said housing includes three primary wire connector cavities being adapted to receive three incoming wires, cables, the primary cavities being disposed on one side of said housing, said housing further including twenty-one wire connector secondary wire connector cavities disposed on the opposite side of said housing, the twenty-one secondary cavities being adapted to receive twenty one outgoing electrical wires, the twenty-one secondary cavities being disposed in two different planes on the opposite side of said block and wherein each primary cavity has seven secondary cavities operatively associated therewith.

22. The multiple wire connector of claim 16, wherein said housing includes on primary wire connector cavity adapted to receive an incoming electrical wire, the primary cavity being disposed on one side of said housing, said housing further having three secondary wire connector cavities adapted to receive three outgoing electrical wires, the three secondary cavities being disposed on the opposite side of said housing, said three secondary cavities being further disposed on at least two different planes of said housing opposite side, said three secondary cavities being operatively associated with said one primary cavity.

* * * * *